US005799421A

United States Patent [19]

Bouleau

[11] Patent Number: 5,799,421

[45] Date of Patent: Sep. 1, 1998

[54] PRESSING IRON AND PROCESS FOR ASSEMBLING SUCH AN IRON

[75] Inventor: Jean-Paul Bouleau, Champfleur, France

[73] Assignee: Moulinex S.A., Paris, France

[21] Appl. No.: 833,973

[22] Filed: Apr. 11, 1997

[30] Foreign Application Priority Data

Apr. 12, 1996 [FR] France ..... 96 04629

[51] Int. Cl.[6] ..... D06F 75/30

[52] U.S. Cl. ..... 38/88

[58] Field of Search ..... 38/74, 77.3, 77.8, 38/77.83, 81, 88, 91; 219/245, 259, 250, 256

[56] References Cited

U.S. PATENT DOCUMENTS

| | | | |
|---|---|---|---|
| 3,413,741 | 12/1968 | Schwartz, Jr. et al. | 38/77.3 |
| 3,986,282 | 10/1976 | Nelson | 38/77.83 |
| 4,115,935 | 9/1978 | Toft | 38/88 |
| 5,094,021 | 3/1992 | Chen | 38/88 X |
| 5,210,395 | 5/1993 | Freeman | 38/88 X |

*Primary Examiner*—Ismael Izaguirre
*Attorney, Agent, or Firm*—Young & Thompson

[57] ABSTRACT

A pressing iron comprises a housing made of plastic material in the form of a hollow body having a base (3) whose upper portion (H) has an opening (O) closed by a cover (C) and whose outlet (D) is closed by a pressing block comprising an upper portion (4) and a lower portion (5) having at least one pressing sole (6), and surmounted, in the front and rear portions respectively, by two hollow projections (8 and 9) connected at their upper portion by a cross member (10) forming a handle and constituted by a trough (11) closed by a cover (12). The rear projection (9) has a wide opening closed by a cover (14) forming a heel. The hollow body (2) and the cover (14) are formed by a shell (1) molded in one piece and having a transverse cross section of generally inverted V shape. The trough (11) of the handle and the internal surfaces (8' and 9') of the projections (8 and 9) opening inwardly.

8 Claims, 6 Drawing Sheets

PRESSING IRON AND PROCESS FOR ASSEMBLING SUCH AN IRON

CROSS REFERENCE TO RELATED APPLICATION

This application corresponds to French application 96/04629 of Apr. 12, 1996, the disclosure of which is incorporated herein by reference.

FIELD OF THE INVENTION

The invention relates to a pressing iron comprising a casing made of plastic material and formed as a hollow body, on the one hand, having a base whose upper portion has an opening closed by a cover and whose outlet is closed by a pressing block comprising an upper portion and a lower portion comprising at least one pressing sole provided with heating means, and, on the other hand, surmounted in its front and rear portions, respectively, by two hollow projections connected in their upper portions by a cross piece forming a handle and constituted by a trough closed by a cover, said rear projection having a wide opening closed by a cover forming a heel.

BACKGROUND OF THE INVENTION

In known pressing irons, the housing is generally made of several pieces of plastic and comprises means for positioning and/or means for locking to permit the assembly of said pieces thereby to constitute said housing.

The use of such housings has numerous drawbacks, namely, on the one hand, the production of a multitude of small different pieces requiring the production of numerous molds and, on the other hand, the assembly of this multitude of small different pieces, thereby increasing the complexity of the assembly operation of the iron as well as its duration, because of the requirement for manual assembly. Moreover, these numerous machining operations and these assembly operations considerably increase the price of the housings.

The object of the invention is to overcome the above drawbacks by providing a simple, economical and easily assembled housing.

SUMMARY OF THE INVENTION

According to the invention, the hollow body and the cover are formed by a shell molded from one piece and having a transverse cross section of generally inverted V shape, the trough of the handle and the internal surfaces of the projections opening inwardly.

Thanks to the new design of the housing according to the invention, there is minimized as much as possible the number of pieces constituting said housing and, because of this, the molding is simplified and the duration of the assembly operation of the pressing iron is shortened. The gains thus obtained contribute to lowering the cost of a pressing iron. Moreover, this new design is practical, because the various elements of the pressing iron are simple to the point that an operation assembly of the pressing iron poses only minimum difficulties.

BRIEF DESCRIPTION OF THE DRAWING

The characteristics and advantages of the invention will become further apparent from the description which follows, given by way of non-limiting example, with reference to the accompanying drawings, in which.

DETAILED DESCRIPTION OF THE INVENTION

Figure 1:
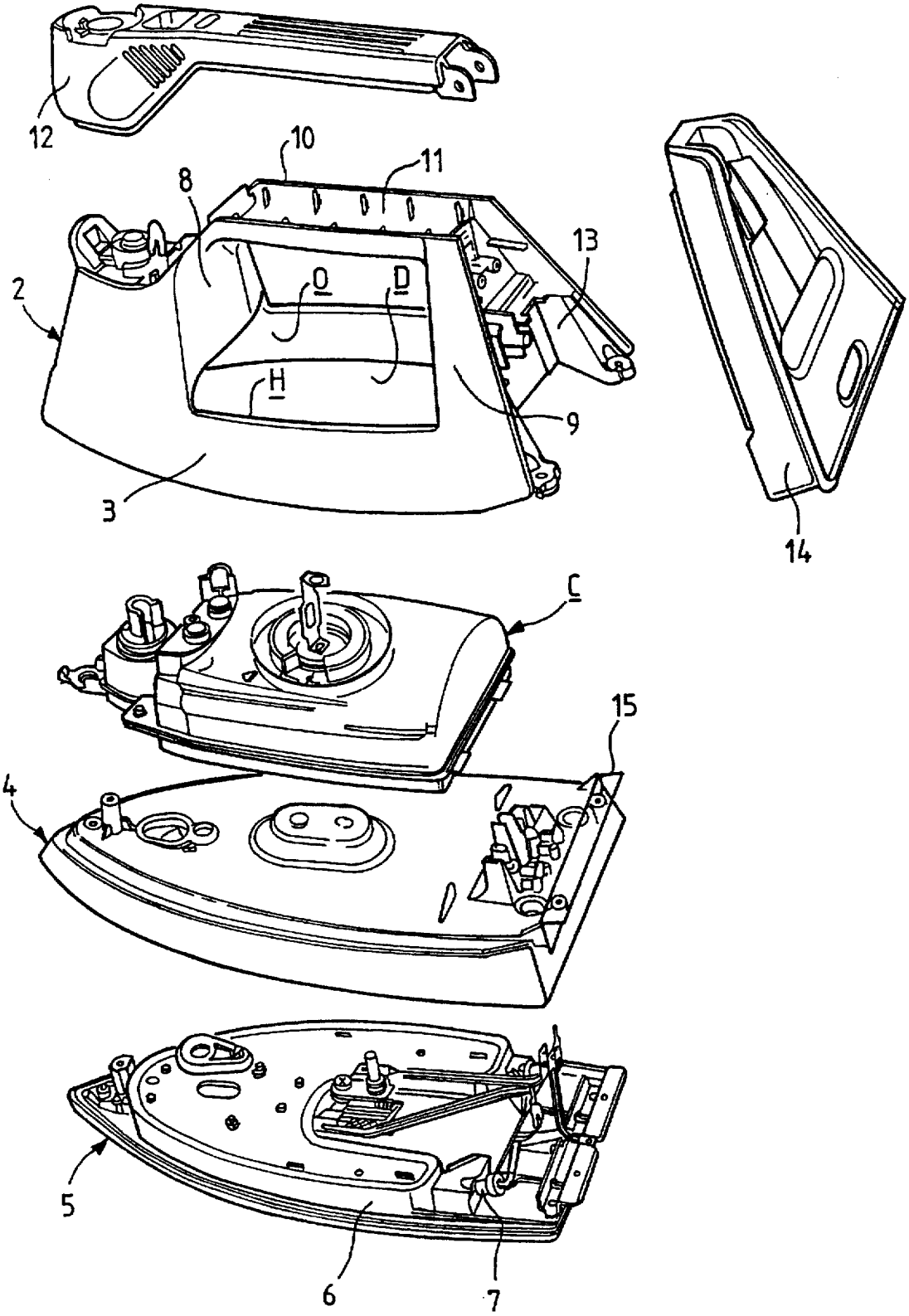
FIG. 1 is a schematic exploded perspective view of a pressing iron showing the prior art.

The prior art pressing iron shown schematically in the exploded view of FIG. 1 comprises a housing made of a plastic material and formed from a hollow body 2, on the one hand, having a base 3 whose upper portion H has an opening O closed by a cover C and whose outlet D is closed by a pressing block comprising an upper portion 4 generally forming a heat screen and a lower portion 5 comprising at least one pressing sole 6 provided with heating means 7, and, on the other hand, surmounted at its front and rear portions by two hollow projections 8 and 9 connected at their upper portion by a cross piece 10 forming a handle and constituted by a trough 11 closed by a cover 12, said rear projection 9 having a wide opening 13 closed by a cover 14 forming a heel.

The upper portion 4 of the pressing block is fixed to the lower portion 5 of said pressing block by any known means such as screws or a clamp. The upper portion 4 has the shape of a hat and is made of a material resistant to high temperatures, for example a resin of the type sold under the mark "Bakelite". The upper portion 4 of the pressing block comprises in its rear portion a projecting end 15.

Figure 2:
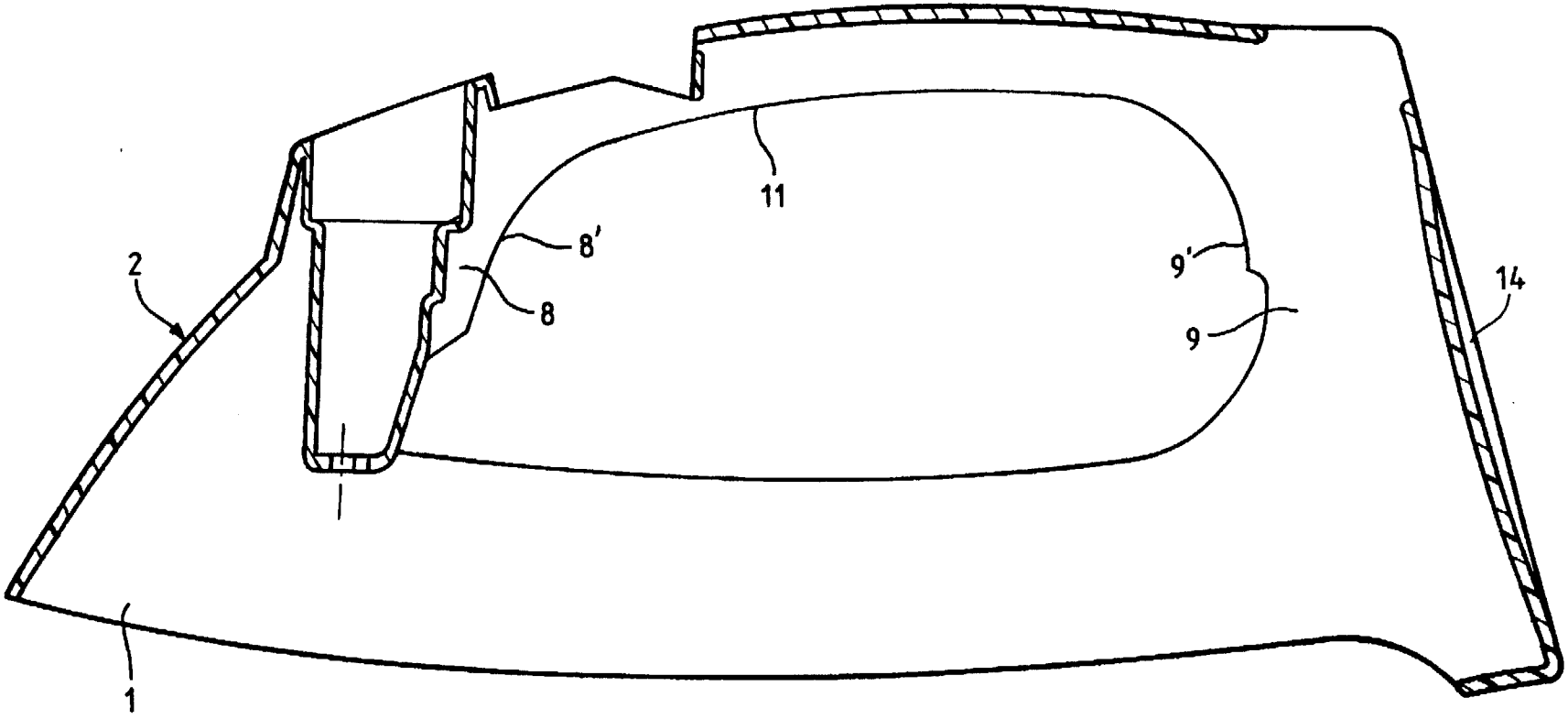
FIG. 2 is a schematic view in vertical cross section of a housing alone, of a pressing iron according to the invention.

As seen in FIG. 2 and according to the invention, the hollow body 2 and the cover 14 are formed by a shell 1 molded in one piece and having a transverse cross section of generally inverted V shape, the trough 11 of the handle and the internal surfaces 8' and 9' of the projections 8 and 9 opening inwardly of the shell.

Figure 3:
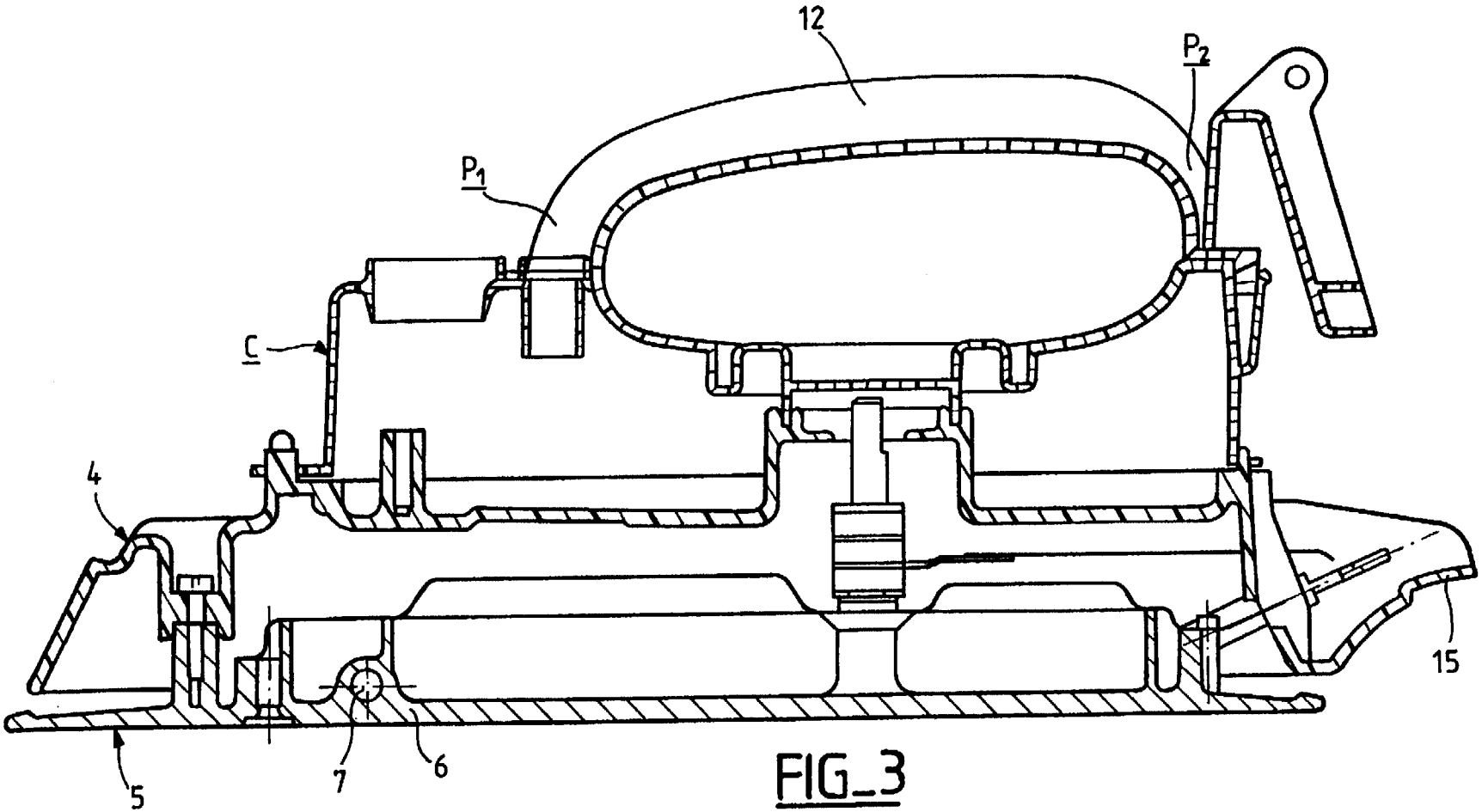
FIG. 3 is a fragmentary schematic vertical cross-sectional view of a pressing iron showing a pressing block and a cover according to the invention.

As is seen in FIG. 3, the upper surface of the upper portion 4 of the pressing block carries the cover C made of a plastic material and supporting, in its front and rear regions, portions of the cover P1 and P2 for each of the internal surfaces 8' and 9' of the two projections 8 and 9 and which are attached to the cover 12 and the trough 11.

In a preferred embodiment, the portions of the cover P1 and P2 and the cover 12 of the trough 11 are molded from one piece.

Thanks to this embodiment, it will be understood that once the shell 1 is obtained by molding, it suffices to emplace within the shell the cover C and the portions of the cover P1 and P2 and the cover 12 to obtain an easily assemblable assembly on the pressing block.

As will be understood, the cover C carried by the pressing block as described above with reference to a pressing iron of the dry type shown in FIG. 3, can also be applied to a pressing iron of the steam type.

Figure 4:
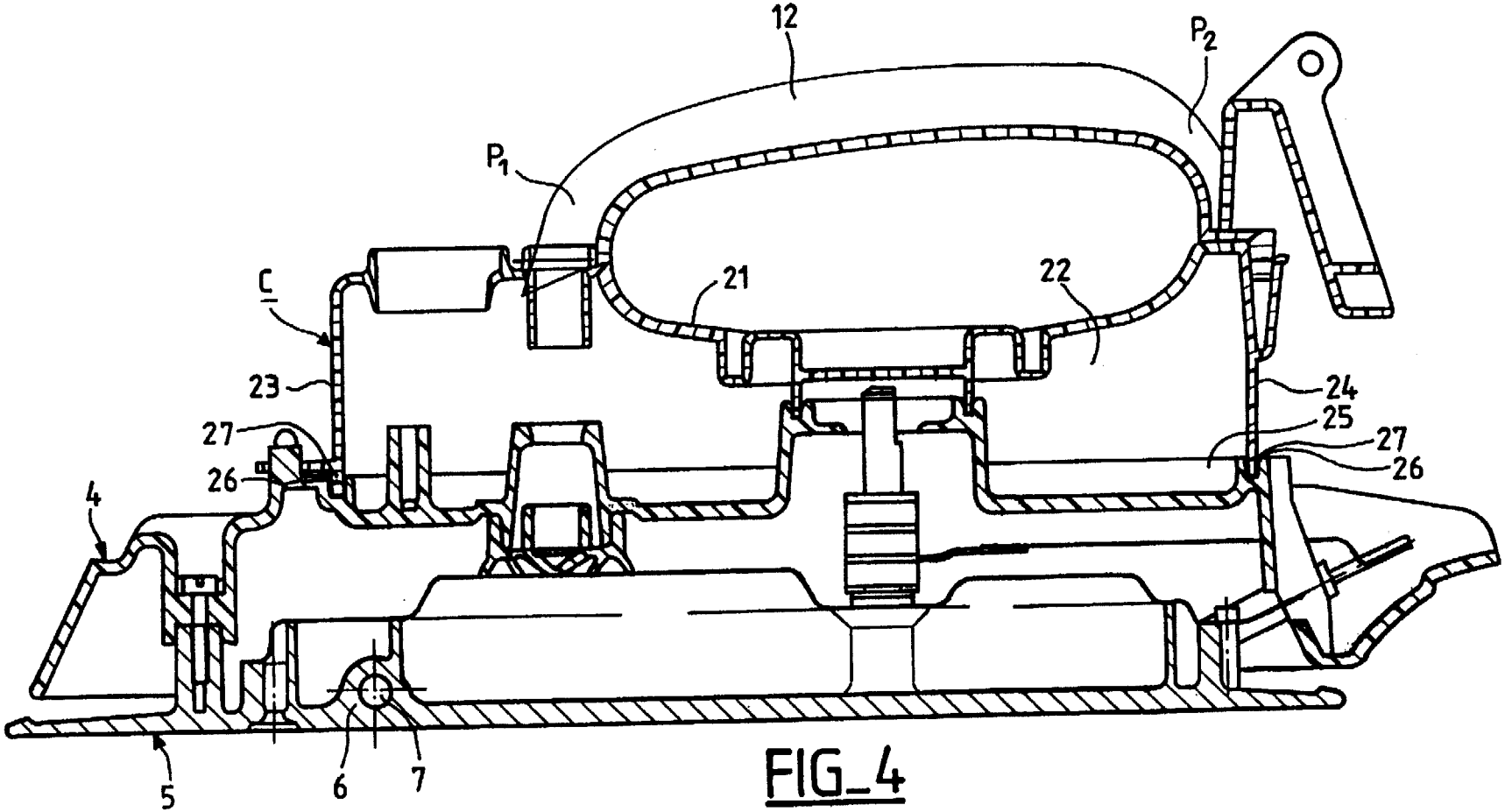
FIG. 4 is a fragmentary vertical cross-sectional schematic view of a steam pressing iron according to the invention and showing a pressing block provided with a water reservoir and a handle portion.
Figure 5:
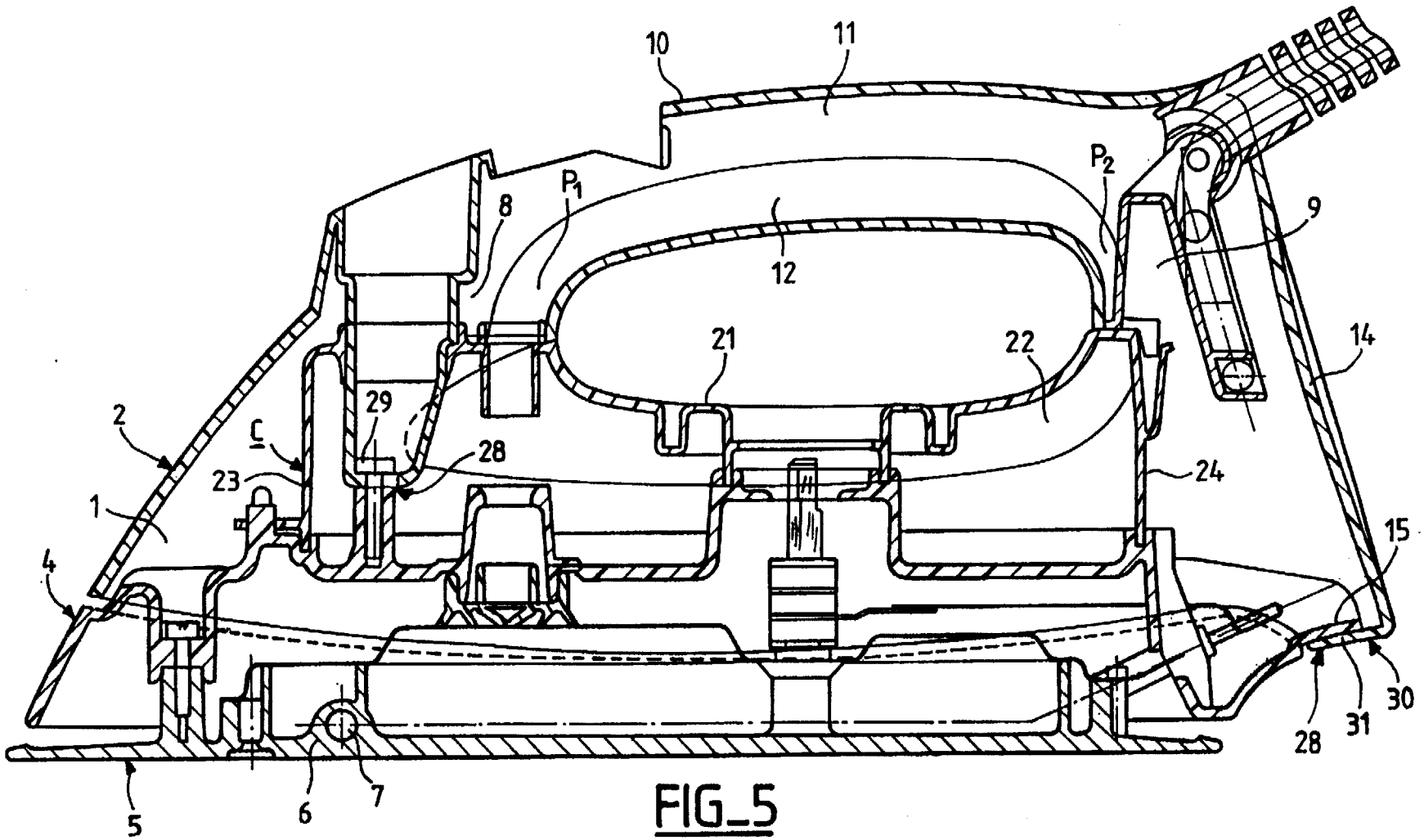
FIG. 5 is a vertical cross-sectional schematic view of a steam pressing iron according to the invention at the end of the operation of mounting the housing on the assembly comprised by the pressing block and the cover.
Figure 6:
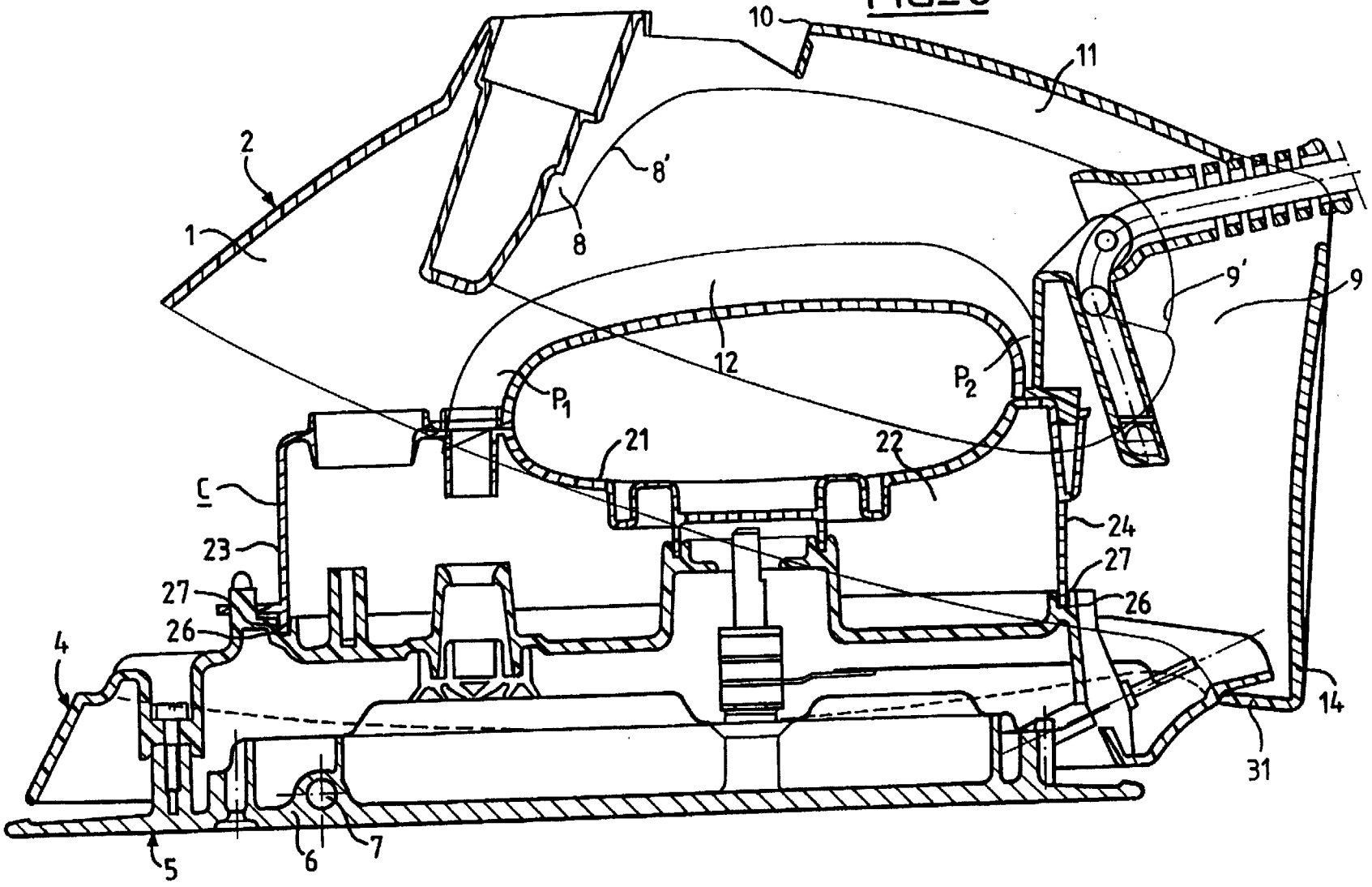
FIG. 6 is a vertical cross-sectional schematic view of a steam pressing iron according to the invention in the course of the operation of mounting the housing on the pressing block-cover assembly.

To facilitate understanding of the drawings shown in FIGS. 4 to 6 and relating to a steam iron, the same references designate the same members as though shown in FIGS. 1 to 3.

As shown in FIG. 4, the cover C being in the shape of an inverted cup and forming a portion of the water reservoir, this cover C comprises an elongated upper wall 21 supporting the assembly of the portions of the cover P1 and P2 and the cover 12, two lateral longitudinal walls of which only one 22 is shown, two front and rear transverse walls 23 and 24, respectively, and an outlet 25 closed by the upper surface 4 of the upper portion of the pressing block, thereby delimiting the volume of the water reservoir.

The upper surface of the upper portion of the pressing block has a peripheral groove 26 in which nests with the securement and sealing means 27, the peripheral edges of the side walls 22 and transverse walls 23 and 24. The securement and sealing means 27 are constituted for example by a silicone joint.

Thanks to the embodiment of such a cover, it will be understood that there is a fewer number of pieces required for a water reservoir in a steam pressing iron. Thus, in the known steam pressing irons, the water reservoir is formed from one piece molded independently of a transparent material and is maintained on the pressing block by known securement means. This design therefore increases the complexity of assembly of the different pieces constituting the pressing iron as well as the cost of such an iron.

As is seen in FIG. 5, the one-piece molded shell 1 is maintained on the cover C and the pressing block by attachment means 28. Said attachment means 28 of the shell 1 comprise, in the front portion of the upper portion 4 of the pressing block, an anchoring member 29 for the shell 1 to the upper part 4 of the pressing block and, in the rear portion of the lower portion 5 of the pressing block, a hooking device 30 for the shell on the projecting end 15 of the upper portion 4 of the pressing block.

The anchoring member 29 of the one-piece molded shell to the upper portion 4 of the pressing block is, for example, a screw which comes into engagement with the upper portion 4, and the hooking device 30 comprises a seat 31 secured to the molded shell 1, provided in the lower portion of the cover 14, directed inwardly and adapted to come into engagement with the projecting end 15 of the upper portion 5 of the pressing block.

Thanks to this assembly of the one-piece molded shell 1, it will be understood that there is avoided, in the rear portion of the upper portion 4 of the pressing block, both anchoring means such as screws or tongues provided on the upper portion 4, and that in this way, whilst saving space, the complexity of assembly of the various elements of the steam pressing iron is decreased and the cost of such an iron is lowered.

Thus, whether for a steam pressing iron or a dry pressing iron, the assembly process of the shell 1 on the pressing block of the pressing iron is the same. As shown in FIG. 6, said process consists in bringing into engagement, by nesting, the seat of the cover 14 of the shell 1 against the projecting end 15 of the upper portion 4 of the pressing block, then pivoting as shown by the arrow F, to ensure the maintenance in correct position of the shell 1 on the upper portion 4 of the pressing block by the anchoring member 29 located in the front region of the upper portion 4.

Finally, there are positioned in the emplacements provided for this purpose in the shell 1, the last elements necessary at the end of assembly of the iron, given the type of pressing iron to be produced.

This new-process can thus be automated in part and has the advantage of being simple and economical.

What is claimed is:

1. In a pressing iron comprising a housing of plastic material formed of a hollow body (2) having a base (3) whose upper portion has an opening closed by a first cover of plastic material and whose outlet is closed by a pressing block comprising an upper portion (4) and a lower portion (5) comprising at least one pressing sole (6) provided with heating means (7) and surmounted in respective front and rear portions with two hollow projections (8 and 9) connected at their upper portion by a cross member (10) forming a handle and constituted by a trough (11) closed by a second cover (12), said rear projection (9) having a wide opening closed by a third cover (14) forming a heel; the improvement wherein the hollow body (2) and the third cover (14) are formed by a shell (1) molded in one piece and having a transverse cross section of generally inverted V shape, the trough (11) of the handle (10) and the internal surfaces (8' and 9') of the projections (8 and 9) opening inwardly; the upper portion (4) of the pressing block having an upper surface which carries the first cover which supports, in front and rear regions, cover portions (P1 and P2) for each of the internal surfaces (8' and 9') of the two projections (8 and 9), and said internal surfaces being attached to the second cover (12).

2. Pressing iron according to claim 1, wherein the first cover is in the form of an inverted cup and forms a portion of a water reservoir, said first cover comprising an elongated upper wall (21) supporting the assembly of the cover portions (P1 and P2) and the second cover (12), two lateral longitudinal walls (22), two transverse front and rear walls (23 and 24) and an outlet (25) closed by the upper surface of the upper portion (4) of the pressing block, thereby delimiting the volume of the water reservoir.

3. Pressing iron according to claim 2, wherein the upper surface of the upper portion (4) of the pressing block has a peripheral groove (26) in which nest with securement and sealing means (27) peripheral edges of the lateral walls (22) and transverse walls (23 and 24).

4. Pressing iron according to claim 3, wherein the securement and sealing means (27) are constituted by a silicone joint.

5. Pressing iron according to claim 1, wherein the one-piece molded shell (1) is maintained on the first cover and on the pressing block by securement means (28).

6. Pressing iron according to claim 5, wherein the upper portion (4) of the pressing block comprises, in its rear portion, a projecting end (15), the securement means (28) of the shell (1) comprising, in a forward portion of the upper portion (4) of the pressing block, an anchoring member (29) for the shell (1) at the upper portion of the pressing block, and, in a rear portion of the lower portion (5) of the pressing block, a hooking device (30) for the shell (1) on the projecting end (15) of the upper portion (4) of the pressing block.

7. Pressing iron according to claim 6, wherein the anchoring member (29) of the shell (1) to the upper portion (4) of the pressing block is a screw which comes into engagement with the upper portion (4), and wherein the hooking device (30) comprises a seat (31) secured to the molded shell (1), provided in the lower portion (5) of the heel (14), directed to the interior and adapted to come into engagement with the projecting end (15) of the upper portion (4) of the pressing block.

8. Assembly process for a pressing iron according to claim 7, wherein there are placed in bearing engagement, by nesting, the seat (31) of the heel (14) of the shell (1) against the projecting end (15) of the upper portion (4) of the pressing block, then by pivoting, a correct positioning is effected of the shell (1) on the upper portion (4) of the pressing block by the anchoring means (29) located in the forward region of the upper portion (4).

* * * * *